United States Patent [19]

Kobayashi et al.

[11] Patent Number: 4,993,196

[45] Date of Patent: Feb. 19, 1991

[54] METHOD FOR REMOVING BURRS FROM WORKPIECES

[75] Inventors: Hisamine Kobayashi; Toshiharu Shimizu, both of Nagoya, Japan

[73] Assignee: Tipton Manufacturing Corporation, Nagoya, Japan

[21] Appl. No.: 374,919

[22] Filed: Jul. 3, 1989

[30] Foreign Application Priority Data

Aug. 5, 1988 [JP] Japan ..... 63-196617

[51] Int. Cl.[5] ..... B24B 1/00

[52] U.S. Cl. ..... 51/281 P; 409/143

[58] Field of Search ..... 409/143, 131, 132, 138, 409/139, 140; 51/281 P, 290; 408/1

[56] References Cited

FOREIGN PATENT DOCUMENTS

| | | | |
|---|---|---|---|
| 3122044 | 12/1982 | Fed. Rep. of Germany | 51/290 |
| 53594 | 4/1977 | Japan | 51/281 P |
| 62-28376 | 7/1987 | Japan . | |
| 426800 | 10/1974 | U.S.S.R. | 51/290 |
| 859133 | 8/1981 | U.S.S.R. | 51/281 P |
| 1323254 | 7/1987 | U.S.S.R. | 409/143 |

*Primary Examiner*—William Briggs

*Attorney, Agent, or Firm*—Wenderoth, Lind & Ponack

[57] ABSTRACT

A method of and an apparatus for removing any burrs or other undesired defects from a workpiece having a bore therein is disclosed. Specifically, those burrs or other defects that are to be removed may be present on the marginal edge or interior of the bore. The method and apparatus are specifically designed to allow a rotary tool to meet the specific relationship requirements between the number of revolutions (n) and number of reciprocating motions (N), i.e., $\frac{1}{3} \leqq n/N \leqq 1$, when the rotary tool travels forward and backward within its specific stroke range.

2 Claims, 3 Drawing Sheets

METHOD FOR REMOVING BURRS FROM WORKPIECES

BACKGROUND OF THE INVENTION

1. Field of the Invention

The present invention relates genreally to the art of workpiece surface finishing, and more particularly provides the deburring (removal of burrs), finishing, polishing, and other like functions for workpieces that usually carry respective bores to be worked on and finally finished. More particularly, the present invention uses a rotary tool such as a brushing device to accomplish those functions, which includes a functional element that may be applied upon the workpieces to remove any burrs from the marginal edges and/or interiors of the bores through the workpieces.

It should be understood in connection with the present invention that the term "rotary tool" referred to hereinafter may include all tools having a resilient property and having a particular shape such as cylindrical, conical/tapered, and the like, which are made of a bundle of wire-brushes, fibrous materials, or plastics (including nylon) that contain any appropriate adrading sustances, or buffs which are made of cloth. It should also be understood that those tools have the good resilient contact that allows them to engage the corners of the workpiece to be worked on, and provide the mechanical rigidiy or strength or functional ability or both. Thus, the good surface finishing results such as deburring can be obtained by using those tools.

2. Description of the Prior Art

There is a conventional surface finishing method or apparatus that is designed to provide the deburring function, for example. According to that method or apparatus, the deburring operation occurs for a workpiece with a bore from which any burrs are to be removed. During the deburring process, the workpiece is placed with regard to the apparatus to ensure that the center axis through the bore is properly aligned with the center axis through the rotary tool on the apparatus. Then, the rotary tool is rotated with a high speed while it is being inserted into the bore through the workpiece. The deburring operation actually occurs by moving the rotary tool with a reciprocating motion with regard to the workpiece (this teaching is disclosed in Japan's Utility Model Application No. 62-28376 which is now published).

The conventional deburring method or apparatus is disadvantageous in that the rotary tool has the significantly great ratio of the number of revolutions (n) to the number of reciprocating motions (N) (such as $50<n/N<100$). As such, the rotary tool must have its blade tip placed at a relatively small angle with regard to the bore of the workpiece from which any burrs are to be removed. That is, the rotary tool must have its blade tip placed in its horizontal position against the bore of the workpiece. In that way, the blade tip can easily deviate or escape from the point where any burrs that should thereby be removed are located, so that not all burrs may completely be removed.

SUMMARY OF THE INVENTION

It is therefore one principal object of the present invention to offer a rotary tool that is particularly designed to provide a smaller number of revolutions in relation to the number of reciprocating motions, thereby eliminating the problems as mentioned above.

The method according to the present invention consists of causing a rotary tool to be inserted into a workpiece having a bore from which any burrs are to be removed while it is being rotated with a specific number of revolutions, and then causing it to travel with a specific number of reciprocating motions whereby any burrs that appear around the bore's marginal edges or interior can be removed, wherein the number of revolutions (n) and the number of reciprocating motions (N) have a specific ratio range of $\frac{1}{3} \leqq n/N \leqq 1$ within which the rotary tool is operated to meet those specific requirements for the number of revolutions and number of reciprocating motions.

Conceptually, the method is preformed such that any burrs that may be present within the bore through the workpiece are located in the mid way of the stroke range within which the rotary tool travels forward or backward.

The apparatus according to the present invention comprises a rotary shaft which is powered for driven rotation by any suitable drive power means such as an electric motor, the rotary shaft carrying a tool shaft rotatably and axially slidably. The tool shaft holds a rotary tool at its tip, and has a slit or recess such that the rotary tool can selectively have one, two, or three reciprocating motions during one complete revolution of the tool shaft. To this end, and projection is provided to engage the slit or recess. The slit or recess is designed to allow the reciprocal motion of the rotary tool to follow a substantially sine curve.

As described, the rotary tool provides the number of revolutions (n) that is smaller than the number of reciprocating motions (N), that is, $\frac{1}{3} \leqq n/N \leqq 1$. This advantageously increases the angle at which the blade tip of the rotay tool is to engage the portion of the workpieces where any burrs are present. The striking force of the rotary tool against that portion can increase accordingly. Thus, the deburring capability of the rotary tool can be enhanced.

Another advantage of the rotary tool is that its blade tip can engage the portion where the burrs appear, at an angle of nearly 45° with regard to that portion, since that portion is always located in the mid way of the stroke range of the blade tip, and the rotary tool travels in reciprocal movement at the highest rate when its blade tip engages that portion. This provides the efficient deburring operation.

BRIEF DESCRIPTION OF DRAWINGS

Those and other objects and advantages of the present invention will become more apparent from the detailed description of the several preferred embodiments that follows with reference to the accompanying drawings, in which.

DESCRIPTION OF THE PREFERRED EMBODIMENTS

Figure 1:
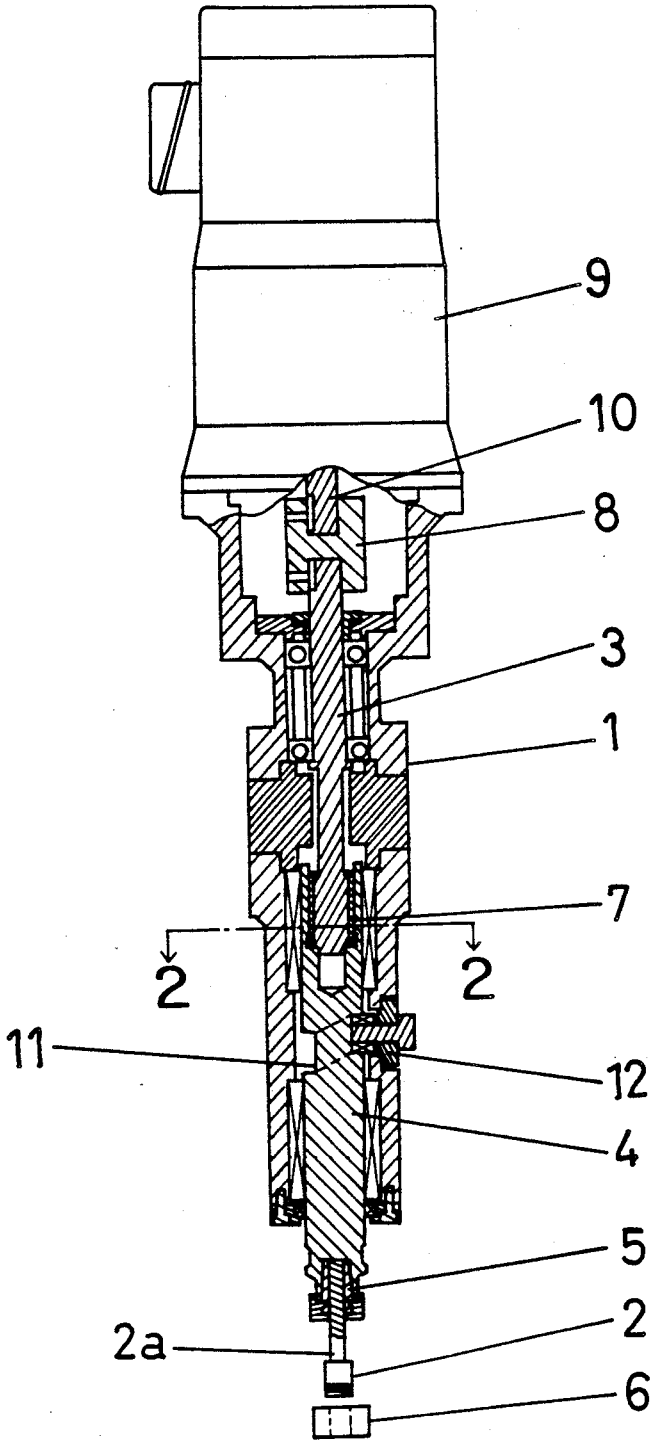
FIG. 1 is a partly section, front elevation of one preferred embodiment of the present invention.
Figure 2:
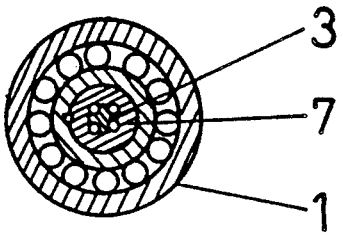
FIG. 2 is a partly sectional view taken along the line 2—2 in FIG. 1.

Referring to FIGS. 1 and 2, one preferred embodiment fo the present invention is now described in further detail.

In FIG. 1, a rotary tool assembly includes a rotary tool 2, a tool shaft 4, and a rotary shaft 3. Those elements are coupled together, and are accommodated within a housing 1. The rotary tool 2 has its shaft 2*a* held by a collet chuck 5 which is connected with the tool shaft 4. The rotary tool 2 whould preferably have a diameter that is slightly larger than the internal diameter of the bore through a workpiece 6. A splined casing 7 is provided for connecting the bottom end of the rotary shaft 3 and the upper end of the tool shaft 4, so that the tool shaft 4 can be driven for rotation and for axial sliding movement through the casing 7. For example, the angular-type ball bearing which is known per se (such as the one offered by the Nippon Tomson Co.) may be used for the splined casing 7. The tool shaft 4 may slide up and down along the rotary shaft 3 and may also rotate with the rotary shaft 3 through the intermediary of the splined casing 7. An electric motor 9 is rigidly mounted on the housing 1, and the rotary shaft 10 of the electric motor 9 is connected with the the upper end of the rotary shaft 3 by means of a coupling 8.

The tool shaft 4 has a slit or recess 11 on its central portion, which engages a protrusion 12 provided on the housing 1. For example, the protrusion 12 may be provided in the form of a needle bearing. The type or model that is offered by the Nippon Tomson Co. may be used as this needle bearing.

Figure 3:
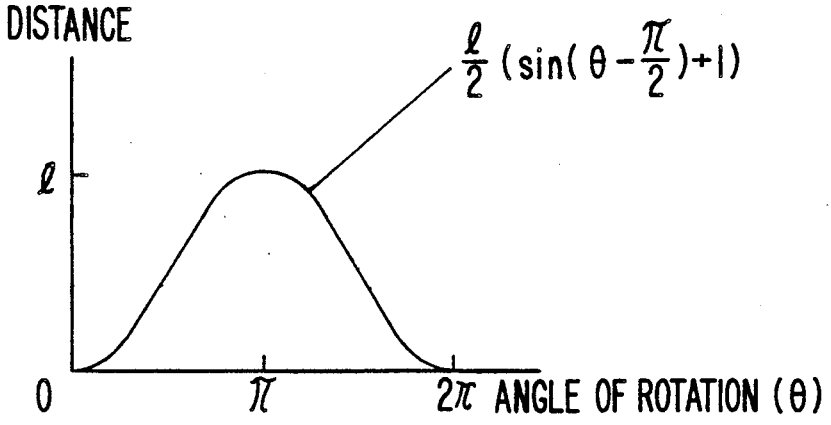
FIGS. 3*a*, 3*b* and 3*c* are typical sine curve diagrams where the letters a, b, and c represent respective forms of a slit or recess.
Figure 3:
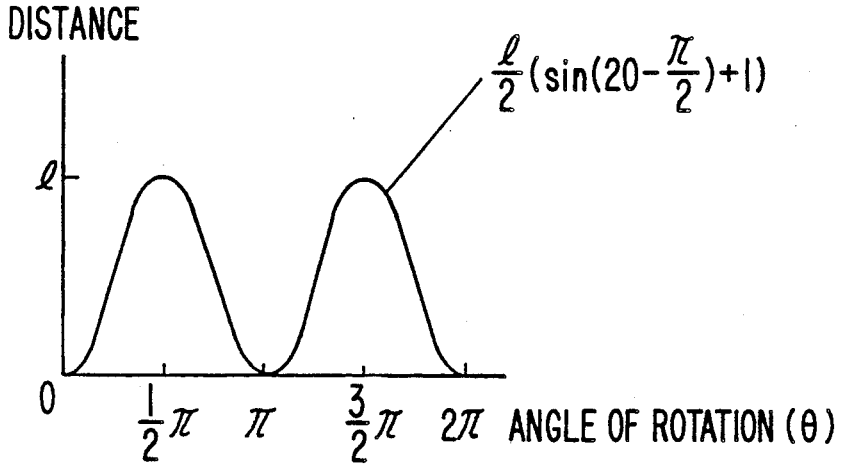
Figure 3:
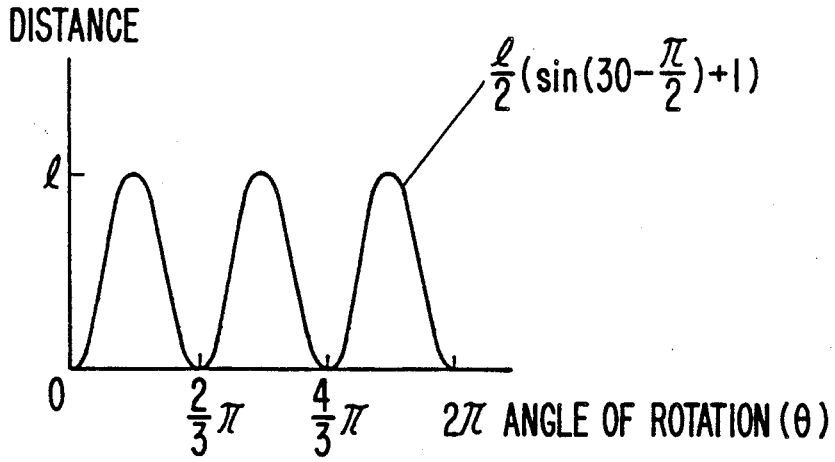

The slit or recess 11 on the tool shaft 4 may be provided to allow the rotary shaft 2 selectively to have on, two, or three reciprocating motions while it is rotated through one complete turn, depending upon the specific deburring requirements. In this case, the slit or recess 11 should preferably be designed to allow reciprocal movement of the rotary tool 2 to follow a substantially sine curve with regard to the bore surface through the workpiece. It is assumed that the angle of rotation for the rotary tool 2 is given as $\theta$, and the distance of stroke over which the rotary tool 2 travels forward or backward is given as l. Then, the slit or recess 11 may be designed to provide $1/2\ (\sin(\theta-\pi/2)+1)$ for one reciprocating motion as shown in FIG. 3(*a*), $1/2\ (\sin(2\theta-\pi/2)+1)$ for two reciprocating motions as shown in FIG. 3(*b*), and $1/2\ (\sin(3\theta-\pi/2)+1)$ for three reciprocating motions as shown in FIG. 3(*c*). Under those respective conditions, the rotary tool 2 can have the respective smooth reciprocating motion.

It should be noted, however, that the slit or recess 11 may have any other form than the sine curve form, as long as the rotary tool 2 can meet the requirements for one, two, or three reciprocating motions while it will have rotated through one complete turn.

It should also be noted that the number of reciprocating motions for the rotary tool 2 is limited to 3, above which the rotary tool would have an adverse effect. As described, the relationship between the number of revolutions (n) and number of reciprocating motions for the rotary tool 2 may be expressed as $\frac{1}{3} \leqq n/N \leqq 1$.

That portion of a workpiece from which any burrs are to be removed should preferably be located mid way, or 1/2, of the stroke range of the rotary tool 2. In this way, the blade tip of the rotary tool may engage that portion at about 45° angle with regard to that portion, and may travel at the highest speed so that its stricking force against that portion can be increased. Thus, any burrs can be removed from that portion with the highest efficiency.

The operation of the preferred embodiment of the present invention as described above is next described in accordance with the conceptual structure thereof. A workpiece 6 to be worked on, such as deburring (removal of burrs) and other surface finishing process, is placed so that that portion of the workpiece from which any burrs are to be removed or on which any other surface finishing process is to be performed is located on the middle of the stroke of the rotary tool 2, and then the motor 9 is turned on. The driving power of the motor is transmitted to the rotary shaft 3, which is driven for rotation. This is followed by driving the tool shaft 4 for rotation. The tool shaft 4 has its slit or recess 11 engage the protrusion 12, which causes the tool shaft 4 to travel up and down. Thus, the rotary tool 2 associated with the tool shaft also reciprocates within the bore through the workpiece. During the number of reciprocating motions as specified, the blade tip of the rotary tool can remove the burrs from the marginal edge or interior of the bore.

For the conventional rotary tool which has been referred to for comparison purposes, it is in practice set for a number of revolutions of 1,800/min., the number of reciprocating motions of 20 to 30/min., and the working time of 12 seconds. Under those conditions, it is almost impossible or difficult to remove those burrs completely. For the rotary tool of the present invention, however, it is set for a number of revolutions of 1,800/min., a number of reciprocating motions of 1,800/min., and a working time of 12 seconds. Under those particular conditions, those burrs can be removed easily and completely.

Although the present invention has been described by referring to the several preferred embodiments thereof, it should be understood that various changes and modifications may be made within the scope and spirit of the invention.

What is claimed is:

1. A method of removing any burrs from a workpiece having a bore which consists of causing a rotary tool to be inserted into a workpiece having a bore from which any burrs are to be removed, causing the rotary tool to be rotated a number of times n per said unit time, causing the rotary tool to travel forward and backward inside the bore a number of times N per said unit time, and removing the burrs from the marginal edge and interior of the bore, wherein the ratio of the number of revolutions (n) and number of reciprocating motions (N) is $\frac{1}{3} \leqq n/N \leqq 1$.

2. The method as defined in claim 1, wherein said step of causing the rotary tool to travel forward and backward within the bore is performed with the portion of the workpiece from which any burrs are to be removed being located mid way of the strock range of the rotary tool.

* * * * *